US005326288A

United States Patent [19]

Lu et al.

[11] Patent Number: 5,326,288

[45] Date of Patent: Jul. 5, 1994

[54] CONTACT HAVING GENERALLY UNIFORM STRESS ACTING THEREON

[75] Inventors: Sidney Lu, Taipei; Gwou-Jong Tseng, Taipei Hsien, both of Taiwan

[73] Assignee: Foxconn International, Inc., Sunnyvale, Calif.

[21] Appl. No.: 22,322

[22] Filed: Feb. 25, 1993

[51] Int. Cl.[5] ..... H01R 13/00

[52] U.S. Cl. ..... 439/851

[58] Field of Search ..... 439/816, 851–855

[56] References Cited

U.S. PATENT DOCUMENTS

| | | | |
|---|---|---|---|
| 3,362,008 | 1/1968 | Berg | 439/851 |
| 3,663,931 | 5/1972 | Brown | 339/218 R |
| 4,655,522 | 4/1987 | Beck | 339/32 M |
| 4,666,227 | 5/1987 | Galizia | 339/64 |
| 4,687,278 | 8/1987 | Grabbe | 439/842 |
| 4,720,277 | 1/1988 | Sakamoto | 439/842 |
| 4,721,484 | 1/1988 | Sakamoto | 439/842 |
| 4,722,704 | 2/1989 | VanDerStuyf | 439/851 |
| 4,767,350 | 8/1988 | Cooper | 439/271 |
| 4,874,338 | 10/1989 | Bakermans | 439/851 |
| 4,886,747 | 12/1989 | Drogo | 439/856 |
| 4,909,746 | 3/1990 | Scholz | 439/82 |
| 5,116,266 | 5/1992 | Seymore et al. | 439/851 |

*Primary Examiner*—Joseph H. McGlynn

[57] ABSTRACT

A female contact (5) comprises a forward contact section (50), a middle retention section (53) and a rearward tail (54). The contact section (50) includes a front generally C-shaped ring (51) at the front end, a rear generally C-shaped ring (52) at the rear end, and three inwardly curved beams (50A, 50B, 50C) bowed to each other intermediate two rings (51, 52). The base beam (50A) is integrally aligned with the retention section (53), and the two auxiliary beam (50B, 50C) are symmetrically positioned in relation to an imaginary plane vertically extending from the base beam (50A). Each beam (50A, 50B, 50C) has expanded portions approximate the front ring (51), the rear ring (52) and the engaging region (500A, 500B, 500C).

9 Claims, 5 Drawing Sheets

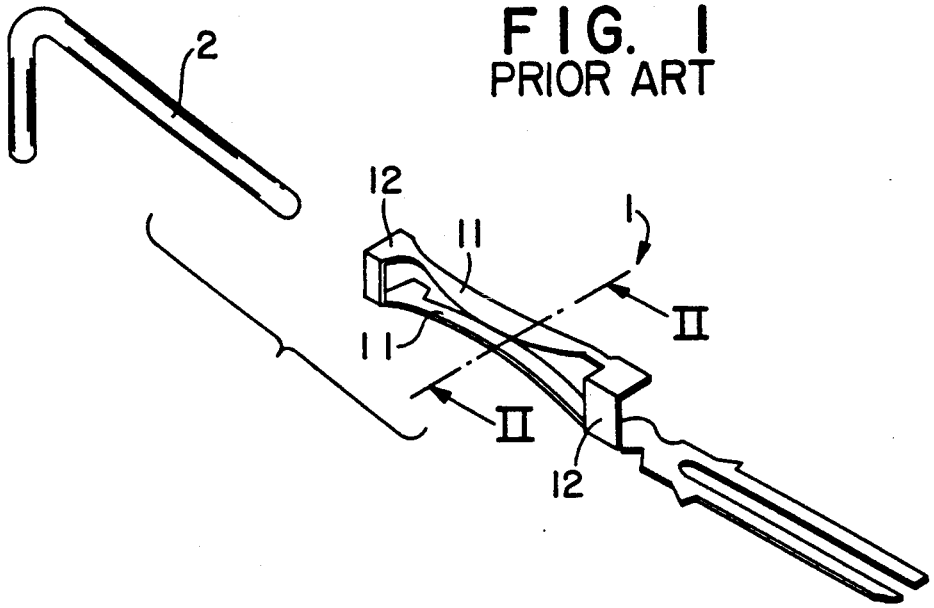
FIG. 1
PRIOR ART
FIG. 2
PRIOR ART
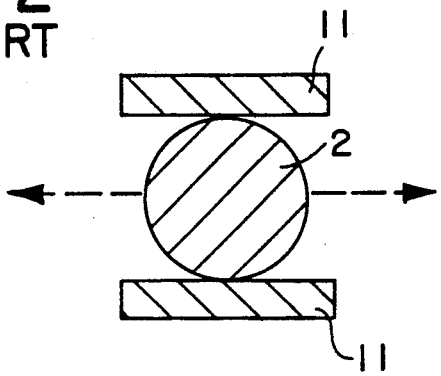
FIG. 4
PRIOR ART
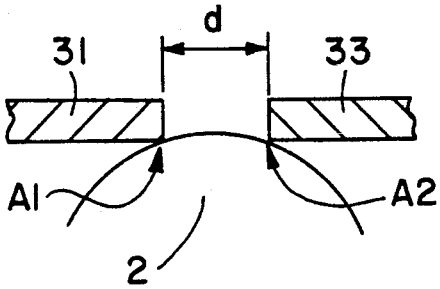

CONTACT HAVING GENERALLY UNIFORM STRESS ACTING THEREON

BACKGROUND OF THE INVENTION

1. Field of The Invention

The invention relates to contacts for use with an IC memory card, especially to a female or receptacle contact including at least three beams wherein each has variant cross-sectional dimension along its length for corresponding to the stress variation thereof, such that the entire beam bears a generally uniform stress along its length when a pin male contact is inserted into the female contact.

2. The Prior Art

As shown in FIG. 1, the typical receptacle or female contact 1 is generally of a socket type having a front and a rear U-shaped sections 12 at two opposite positions and a pair of inwardly bowed beams 11 integrally and respectively extending therebetween. As shown in FIG. 2, the disadvantage of this type prior art contact is that the pin male contact 2 may freely laterally move between this pair of beams 11.

Another type prior art female contact 3 as shown in FIG. 3 discloses a first and a second frames 34, and a base contact section 32 and a first and a second top contact sections 31, 33 oppositely extending between these two frames 34 wherein the first top contact section 31 and the second top contact section 33 side by side abut against each other to intentionally form as a unit for symmetrically and correspondingly incorporating the base contact section 32 to sandwich a pin type male contact 2 therebetween. Referring to FIG. 4, this type prior art female contact not only has the disadvantage as mentioned in the former type prior art, but also, due to manufacturing limitations, has an intention of the space "d" occurring between the oppositely facing edges of the first and the second top contact sections 31 and 33 which results in sharp corners A1 and A2 easily scratching the mating male contact 2. Thus, the first and the second top contact sections 31 and 33 do not function as a unit as originally designed to cooperate with the base contact section 32.

The third type prior art female contact as disclosed in U.S. Pat. No. 4,722,704, has two pairs of beams, each pair perpendicular to each other, for circumferentially retaining the male contact therein. Although the female contact in 4,722,704 may increase the retaining normal force and reduce the insertion force with the mating male contact, it lacks the consideration of uniform stress distribution along its length that enables a long lifetime usage and an appropriate material strength range of the female contact. Hence, this may restrain the designer from selecting an inexpensive material of the female contact to lower the product cost.

Accordingly, an object of the present invention is to provide a female contact which can not only effectively restrict the inserted male contact therein for reliable engagement therebetween, but also, at the same time, achieve a uniform stress distribution along the whole length of each beam of the female contact, thus obtaining a desired retention performance and a long lifetime of the female contact.

SUMMARY OF THE INVENTION

In accordance with one aspect thereof, the invention is generally directed to a female contact. The contact is formed from a blank and has a forward contact section, a middle retention section, and a rearward tail section. The contact section includes a front C-shaped ring and a rear C-shaped ring positioned at two opposite ends thereof, and three spaced apart beams, including two auxiliary and one base beams intermediating therebetween, respectively. Each beam has variant widths along its length, e.g. lateral expansion portions around the junctions with two opposite rings, and around the mating portion with the male contact such that the stress distribution along the entire female contact can be as uniform as possible for long lifetime use.

To obtain a zero value compound forces, the engaging region of each beam with the male contact is designed to be positioned in the same vertical plane transverse to the axis of the female contact for avoiding any unexpected bending moment occurring thereof due to an un-counterbalanced force thereof, wherein the engaging regions of the two auxiliary beams are symmetrically positioned in relation to an imaginary plane vertically extending from the engaging region of the base beam and the three points of the male contact which encounter these three engaging regions may form an isosceles triangle.

BRIEF DESCRIPTION OF THE DRAWINGS

FIG. 1 is a perspective view of a prior art female contact.

FIG. 2 is a cross-sectional view of the female contact of FIG 1 along the line II—II.

FIG. 4 is partially cross-sectional view of the female contact of FIG. 3 to illustrate a space positioned between two juxtaposed top contact sections.

DETAILED DESCRIPTION OF THE INVENTION

Figure 3:
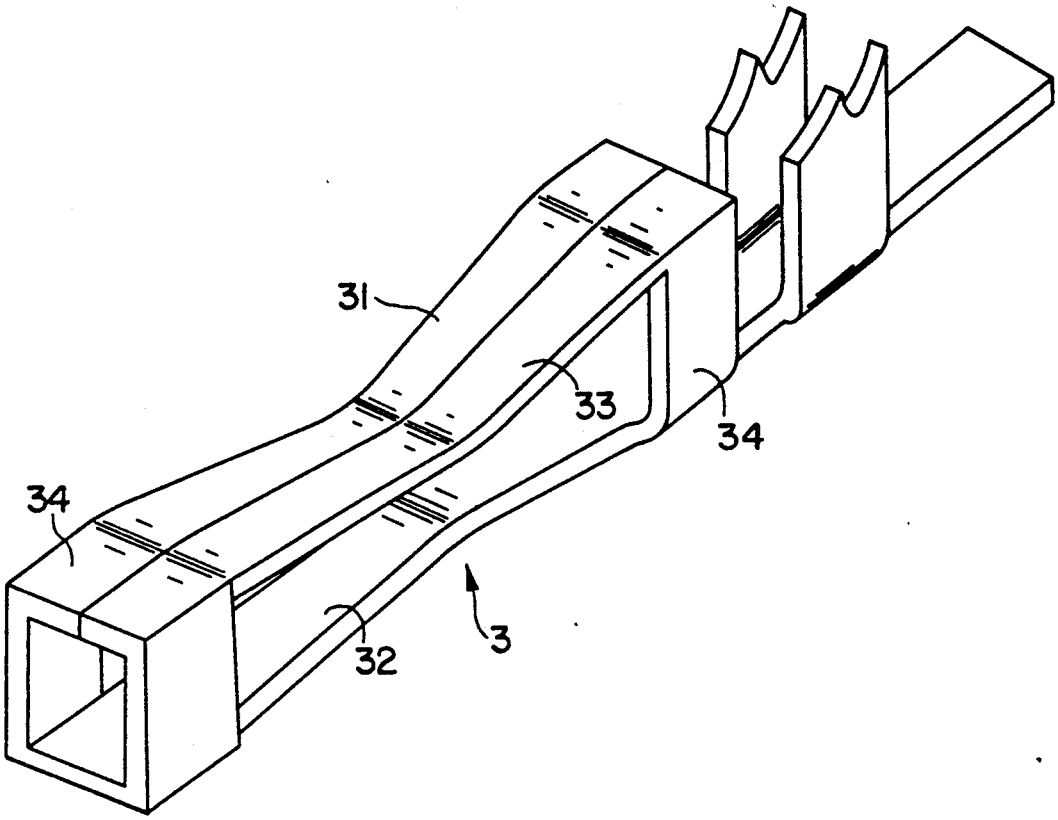
FIG. 3 PRIOR ART
FIG. 3 is a perspective view of another prior art female contact.
Figure 5:
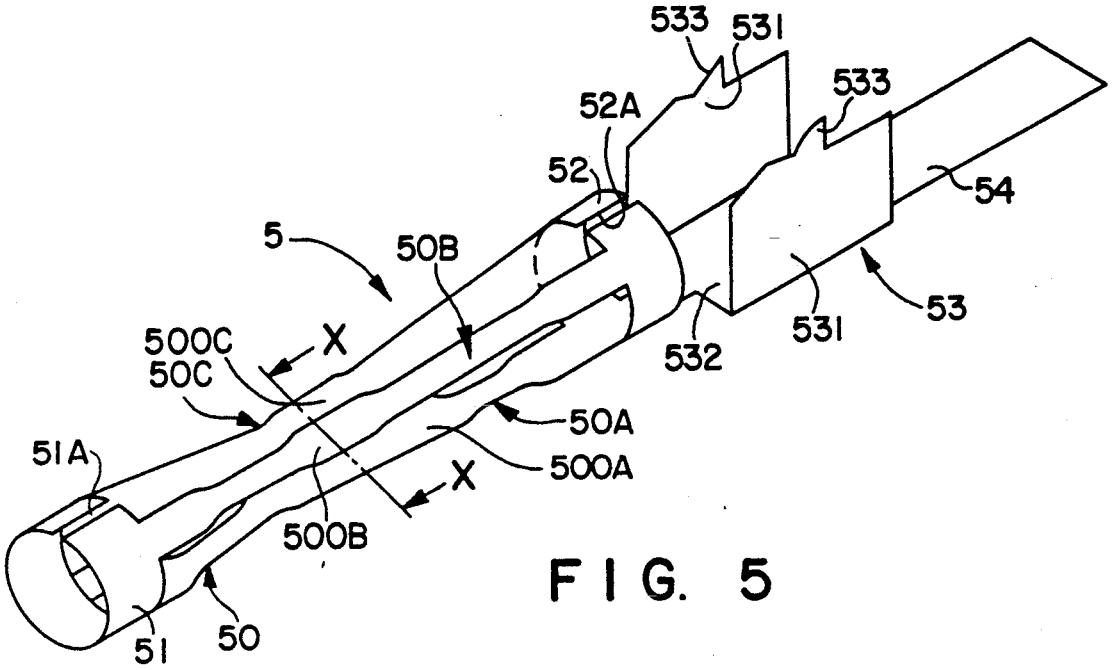
FIG. 5 is a perspective view of a female contact of a preferred embodiment in accordance with the present invention.

With reference to FIG. 5, the female contact 5 includes a forward contact section 50, a middle retention section 53 and a rearward tail 54. The contact section 50 includes a front generally C-shaped ring 51 at the front end and a rear generally C-shaped ring 52 at the rear end, and three inwardly curved beams 50A, 50B and 50C bowed to each other intermediate these two rings 51, 52, respectively, wherein the base beam 50A is integrally aligned with the retention section 53, and the two auxiliary beams 50B, 50C are symmetrically positioned above in relation to an imaginary plane vertically extending from the base beam 50A. In this embodiment, the contact section 50 is formed from a blank so the auxiliary beams 50B and 50C may be stamped to be symmetric in relation to the base beam 50A when the blank is in an extended condition, i.e., in an unrolled condition. It is also appreciated that the front ring 51 and the rear ring 52 each has an axial slot 51A, 52A extending thereof for enhancement of their elasticity after the blank is rolled to form its final shape.

The retention section 53 has a U-shaped body including two side walls 531 and a bight 532 integrally connected therebetween. The bight 532 is integrally aligned with and intermediate the tail 54 and the base beam 50A. The side walls 531 are perpendicular to the bight 532 and have barbs 533 on the top, respectively for secure engagement with the connector (not shown) in which the contact 5 is received. Generally speaking, the contact section 50 is to mate with a pin type male contact which is inserted therein, the retention section 53 is to retain the contact 5 within the connector, and the tail 54 is to be connected to the other circuit path in the rear.

Figure 6:
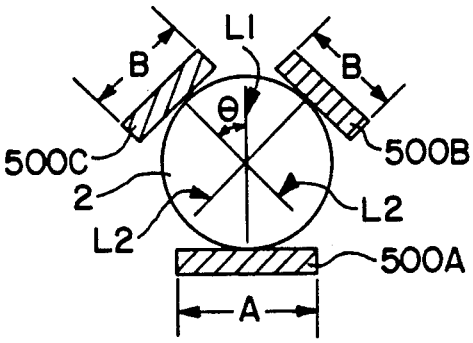
FIG. 6 is a cross-sectional view of the female contact in FIG. 5, accompanying an inserted male contact taken along lines X—X to show the structural positions of the beams relative to each other.

One important feature in the present invention is that the width of each beam 50A, 50B, 50C is variant along its length for at best obtaining generally equivalent stress distribution along the entire length of each beam 50A, 50B and 50C. Referring to FIGS. 5 and 6, each beam 50A, 50B and 50C has an engaging region 500A, 500B and 500C converging toward an axis they surround for matable engagement with the male contact 2 inserted therein. It may be noted that in the present invention the contact section 50 generally performs as a structural beam unit having one "fixed" end, i.e., the ring 52 approximate the retention section 53, and one "simple support" end, i.e., the front ring 51 which may appropriately abut against the inner surface of the corresponding passageway of the connector housing (not shown) in which the contact 5 is inserted. And the normal force exerted between the engaging region 500A, 500B, 500C and the inserted male contact 2 may be deemed as an intermediate load acting on such structural beam unit. Hence, along the whole length of each beam 50A, 50B and 50C of the contact section 50, the larger amount of stress or stress concentration may be derived approximate the junctions with the rings 51, 52 or around the engaging region 500A, 500B, 500C where the active force and the reactive forces initiate and the relatively maximum moments of the forces occur thereabout, than other places, when the width of the beam is in a uniform type.

Figure 7:
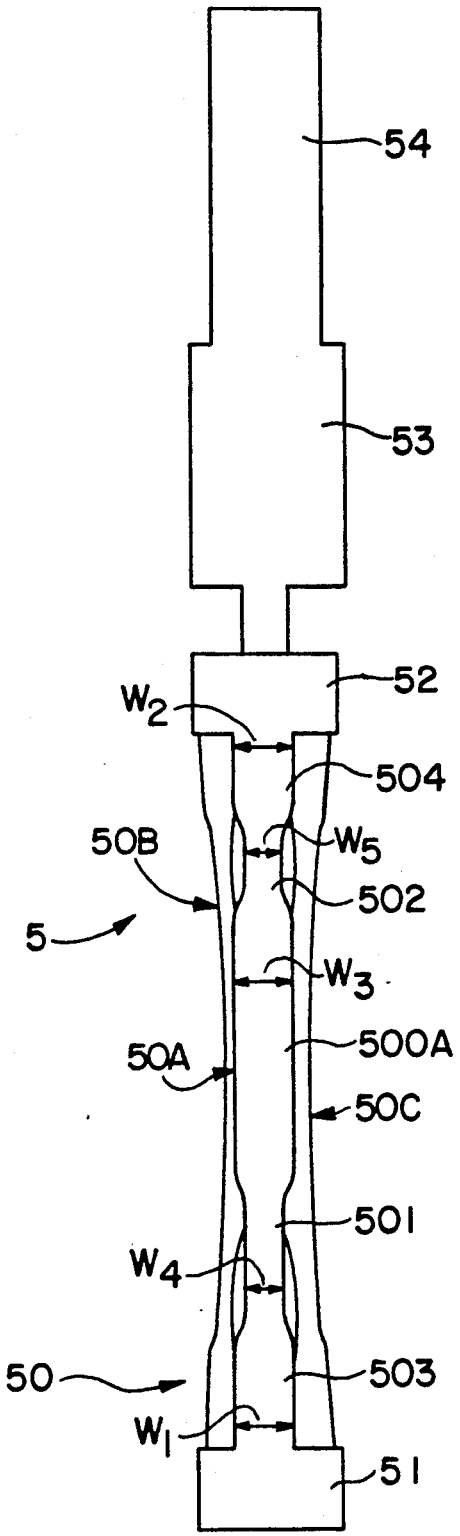
FIG. 7 is a top view of the female contact in FIG. 5 to show the dimension variation along the length of the beam.

Accordingly, referring to FIG. 7, in this embodiment the base beam 50A has a first expanded junction 503 with the front ring 51, a second expanded junction 504 with the rear ring 52, and an expanded engaging region 500A. The widths of the first junction 503, the second junction 504 and the engaging section 500A are W1, W2 and W3, respectively. The base beam 50A also comprises a first harrowed neck 501 intermediate the front ring 51 and the engaging region 500A, and a second narrowed neck 502 intermediate the rear ring 52 and the engaging region 500A. The widths of the first neck 501 and the second neck 502 are W4 and W5, respectively. It can be seen that widths W1, W2 and W3 are larger than widths W4 and W5 so that the stress magnitude along the entire beam can be intentionally and controllably variant in a generally smooth manner even though the active and the reactive forces are exerted about the junctions 503, 504 and the engaging region 500A. In other words, by means of the expanded widths W1, W2 and W3 or their corresponding expanded cross-sectional dimension along with the first junction 503, the second junction 504 and engaging region 500A, the original larger stresses thereabout can be reduced to an average level which is conformable to other portions of the beam. Therefore, there is no more phenomena of stress concentration. Preferably, the auxiliary beams 50B and 50C may be configured in a similar manner as the base beam 50A.

From another viewpoint, because the stress is dependently varied with the moment, and the relatively maximum moments occur proximate the rear ring 52 and the engaging region 500A, it is desired to have the absolute value of the moment around the rear ring 52 be equal to that around the engaging region 500A. Hence, the absolute value of the stress along the entire beam 50A, 50B or 50C will not vary too much so that the whole beam will have better stress distribution. Under this condition, i.e., the absolute value of the moment around the rear ring 52 being equal to that around the engaging region 500A, the engaging region 500A is designedly located at a position where is spaced from the rear ring 52 in a distance of $(2-\sqrt{2})$ length of the beam 50A. It can be understood that this is an optimal structure in the present invention for equalizing the relatively maximum moment and/or stress absolute values around the rear ring 52 and the engaging region 500A so that there are balanced and smaller moments or stresses around the rear ring 52 and the engaging region 500A, and which make the entire beam have a better stress distribution thereof and make the designer more freely select some inexpensive material which has inferior strength and elasticity for the contact design.

Another feature of the present invention is to provide a zero value compound force which acts on the inserted male contact for avoiding any improper bending moment imposed on the male contact. It is also desired that each beam 50A, 50B and 50C may endure a generally equal stress thereof in comparison with each other for accomplishment of uniform stress distribution not only along the individual beam 50A, 50B or 50C, but also along the entire structure of the contact section 5. To implement these intentions, it can be noted that in the present invention, the engaging regions 500A, 500B and 500C may be designedly positioned in the same transverse plane for obtaining a zero value compound force acting on the inserted male contact. Moreover, to have each beam stress 50A, 50B and 50C have generally the same stress thereof, the width A of the engaging region 500A of the base beam 50A is equal to the width B of the engaging region 500B, 500C of each auxiliary beam 50B, 50C multiplied by case wherein $\theta$ is an included angle defined by lines L1 and L2 which extend toward the center axis surrounded by the beams and are perpendicular to the engaging regions 500A and 500B (500C), respectively, and $0° < \theta < 90°$ while $\theta = 45°$ is optimal for the design, as shown in FIG. 6. It can be understood that a width of the base beam 50A which is located in the same transverse plane with another width of the auxiliary beam 500B, 500C, may also be conformable to this relation.

Figure 8:
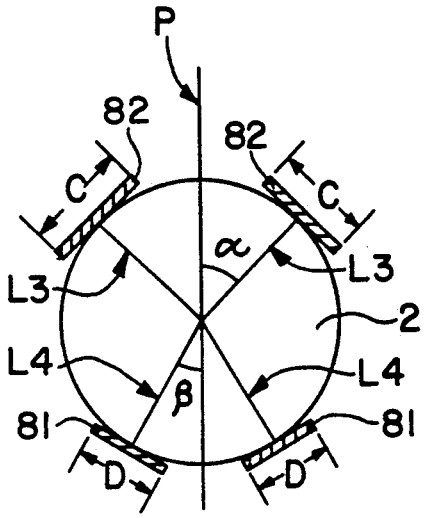
FIG. 8 is a cross-sectional of a female contact, accompanying an inserted male contact, of another embodiment in accordance with the present invention to show a four beams design thereof.

As shown in FIG. 8, another embodiment of the present invention includes a pair of base beams 81 to replace the single base beam 50A of the former embodiment and another pair of auxiliary beams 82 similar to the original auxiliary beams 50B and 50C. Similarly, to obtain the same balanced stress for each beam 81, 82, a formula "$C\cos\alpha = D\cos\beta$" is presented therewith wherein C is the width of the engaging region of the auxiliary beam 82, D is the width of the engaging region of the base beam 81, $\alpha$ is defined in a transverse plane by the line L3, which extends inwardly and perpendicular to the auxiliary beam 82, and a vertical plane P perpendicular to the bight of the retention section (not shown), and $\beta$ is in the same transverse plane defined by the vertical plane P and the line L4 which is perpendicular to the base beam 81.

Figure 9:
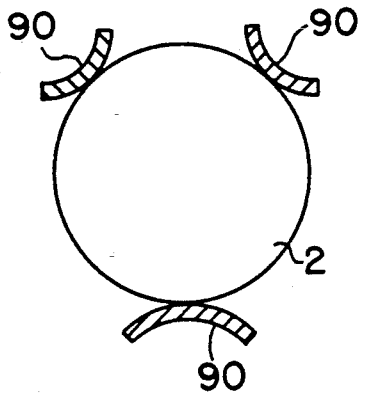
FIG. 9 is a cross-sectional view of a female contact accompanying an inserted male contact, of the third embodiment in accordance with the present invention to show non-flat engaging region thereof.

Further as shown in FIG. 9, to enhance the normal force acting on the inserted male contact for better electrical conductivity, the cross-section of each beam about its engaging region 90 may be formed as generally an arc whereby the inserted male contact 2 may be strongly retained among the beams.

While the invention has been described in connection with what is presently considered to be the most practical and preferred embodiments, it is to be understood that the invention is not limited to the disclosed embodiment by, on the contrary, is intended to cover various modifications and equivalent arrangements included within the spirit and the scope of the appended claims.

Therefore, persons of ordinary skill in this field are to understand that all such equivalent structures are to be included within the scope of the following claims:

What is claimed is:

1. A female contact (5) for use with a connector comprising:

a forward contact section (50) having a front end, a rear end and at least three inwardly curved beams (50A, 50B, 50C) bowed to each other intermediate the front and the rear ends, each beam (50A, 50B, 50C) having an engaging region (500A, 500B, 500C) converging to an axis surrounded by the beams (50A, 50B, 50C) for retainable engagement with an inserted male contact;

a middle retention section (53) integrally connected to the rear end of the contact section (50) for retaining the female contact (5) within the connector; and a rearward tail (54) integrally connected to the middle retention section (53); wherein each beam (50A, 50B, 50C) of the contact section (50) has an expanded width (W1, W2, W3) proximate the front end, the rear end and the engaging region (500A, 500B, 500C).

2. The female contact (5) as described in claim 1, wherein the front end of the contact section (50) is a generally C-shaped ring (51) and the rear end of the contact section (50) is a generally C-shaped ring (52).

3. The female contact (5) as described in claim 1, wherein the retention section (53) has a U-shaped body including two side walls (531) and a bight (532) integrally connected therebetween, each side wall (531) having at least one barb (533) at the top, the bight (532) being aligned with the tail (54).

4. The female contact (5) as described in claim 1, wherein each of said three beams (50A, 50B, 50C) includes a base beam (50A) and two axially beams (50B, 50C), said base beam (50A), being aligned with the tail (54), said two auxiliary beams (50B, 50C) being symmetrically positioned above in relation to an imaginary plane vertically extending from the base beam (50A).

5. The female contact (5) as described in claim 1, wherein the engaging region (500A, 500B, 500C) of each beam (50A, 50B, 50C) is located in a position where is spaced from the rear end in a distance of $(2-\sqrt{12})$ length of the beam (50A, 50B, 50C).

6. A female contact (5) for use with a connector comprising:

a forward contact section (50) having a front generally C-shaped ring (51) at a front end, a rear generally C-shaped ring (52) at a rear end, and at least three inwardly curved beams (50A, 50B, 50C) bowed to each other intermediate the front ring (51) and the rear ring (52);

said beams (50A, 50B, 50C) respectively having engaging regions (500A, 500B, 500C) converging to an axis surrounded by the beams (50A, 50B, 50C), and said engaging regions (500A, 500B, 500C) located in approximately the same transverse plane, each engaging region (500A, 500B, 500C) located at a position where is spaced from the rear ring (52) in a distance of $(2-\sqrt{2})$ length of the beam (50A, 50B, 50C);

a middle retention (53) integrally connected to the rear ring (52) of the contact section (50) for retaining the female contact (5) within the connector, such that the whole contact section (50) can structurally function as an elongated beam element having a simple support proximate the front ring (51), a fixed end proximate the rear ring (52), and a intermediate load acting on proximate the engaging region (500A, 500B, 500C) when a male contact is retainably received in the female contact (5); and a rearward tail (54) integrally connected to the middle retention section (53).

7. The female contact (5) as described in claim 6, wherein each beam (50A, 50B, 50C) has a first expanded junction with the front ring (51), a second expanded junction with the rear ring (52) and the engaging region (500A, 500B, 500C) of the beam (50A, 50B, 50C) has an expanded width intermediate two corresponding junctions.

8. The female contact (5) as described in claim 6, wherein each of the three beams (50A, 50B, 50C) includes a base beam (50) and two auxiliary beams (50B, 50C), said base beam (50A) being in alignment with the tail (54), said two auxiliary beams (50B, 50C) being symmetrically positioned with regard to an imaginary plane vertically extending from the base beam (50A).

9. A female contact (5) for use with a connector comprising:

a forward contact section (50) having a front end, a rear end and four inwardly curved beams (50A, 50B, 50C) bowed to each other intermediate the front end and the rear end, said four beams (81, 82) including a pair of base beams (81) and another pair of auxiliary beams (82), each pair being symmetrical disposed with respect to an imaginary vertical plane P, respectively, each beam (81, 82) having an engaging region converging to an axis surrounded by the beams (81, 82) for retainable engagement with an inserted male contact;

a width C of the engaging region of the auxiliary beam (82) multiplied by $\cos\alpha$ is generally equal to a width D of the engaging region of the base beam (81) multiplied by $\cos\beta$ wherein $\alpha$ is an included angle defined by a first line L3, which is perpendicular to the auxiliary beam (82), and said vertical plane P, and $\beta$ is an included angle defined by said vertical plane P and a second line L4 which is perpendicular to the base beam (81);

a middle retention section (53) integrally connected to the rear end of the contact section (53) integrally connected to barb (533) for secure engagement within the connector; and a rearward tail (54) integrally connected to the middle retention section (53).

* * * * *